United States Patent [19]

Smitte et al.

[11] Patent Number: 4,580,623

[45] Date of Patent: Apr. 8, 1986

[54] HEAT EXCHANGER

[75] Inventors: Cory T. Smitte, Hamilton; Rico D. Ferrelli, Thorold, both of Canada

[73] Assignee: Inglis Limited, Mississauga, Canada

[21] Appl. No.: 656,905

[22] Filed: Oct. 2, 1984

[51] Int. Cl.[4] ..... F28D 1/00

[52] U.S. Cl. ..... 165/150; 165/182; 165/906

[58] Field of Search ..... 165/150, 151, 182, DIG. 9

[56] References Cited

U.S. PATENT DOCUMENTS

| | | | |
|---|---|---|---|
| 1,788,068 | 1/1931 | Scott | 165/151 X |
| 2,347,957 | 5/1944 | McCullough | 165/150 |
| 2,977,918 | 4/1961 | Kritzer | 165/150 X |
| 3,080,916 | 3/1963 | Collins | 165/151 |
| 3,645,330 | 2/1972 | Albright et al. | 165/151 |
| 4,169,502 | 10/1979 | Kluck | 165/151 |
| 4,434,846 | 3/1984 | Lu | 165/182 X |
| 4,449,581 | 5/1984 | Blystone et al. | 165/151 |

*Primary Examiner*—Albert W. Davis, Jr.
*Assistant Examiner*—Peggy A. Neils
*Attorney, Agent, or Firm*—Sim & McBurney

[57] ABSTRACT

An evaporator for refrigeration devices comprises a serpentine tube bundle having a plurality of spaced-apart parallel fins. The tube bundle is arranged to provide sets of tubes in a staggered arrangement to increase the number of tube passes for the height of the evaporator and space the tubes apart to improve efficiency of air flow patterns over the tubes to enhance heat transfer. The fins are made of ultra-thin material of a thickness less than 0.20 millimeters. The fins have an embossed pattern to reinforce the fins through which the tubes extend in appropriately shaped apertures. Due to the thinness of the fins, portions of the fin walls are displaced by inserting the tubes in the apertures to ensure metal to metal contact between the fin and the tubes. The embossed pattern is such to induce turbulence in the air flowing over the fins and tubes to considerably increase the efficiency of the evaporator unit.

15 Claims, 10 Drawing Figures

HEAT EXCHANGER

FIELD OF THE INVENTION

This invention relates to heat exchangers for exchanging heat between a first medium carried in a tube bundle and a second medium flowing over a tube bundle where fins are used to increase the efficiency of heat transfer.

BACKGROUND OF THE INVENTION

Finned typed heat exchangers are commonly used in a variety of heat exchanger-type apparatus. Finned heat exchangers having a tube bundle of a serpentine arrangement and fins between the tubes are used in condensers and evaporators of refrigeration units, air conditioning units and the like.

The standard form of evaporator used in refrigerators involves the use of a serpentine-type tube bundle having a plurality of fins extending perpendicular to the tubes. The fins are planar and usually have a thickness of approximately 0.25 millimeters. Efforts have been made in the past to improve the efficiency of this standard type of evaporator and condensers used in refrigeration devices. U.S. Pat. No. 1,773,249 discloses a condenser arrangement having fins with a plurality of transverse corrugations formed therein. When the fins are assembled and the corrugated portions interconnected, spaces between the fins are defined through which air may flow. Another form of corrugation in thick fins to induce turbulence in the flow of air over the fins of the heat exchanger is disclosed in U.S. Pat. No. 3,645,330. The fins include corrugations which extend transversely of each fin. The fins are all interconnected by collars which are, in turn, welded to the tubes of the coil carrying the medium to be heat exchanged. The corrugations in the fins serve to break up the boundary layer of air flowing over the thick fins.

Further improvements in the fin construction involve the use of apertures in conjunction with corrugations in the tubes, such as disclosed in U.S. Pat. Nos. 3,796,258, 4,365,667 and 3,397,741. The openings in the fins, aside from those openings which receive the tubes of the heat exchanger coil, function as louvres to deflect the flow of air through the fins to enhance heat transfer from the fins to the flowing medium.

All of these forms of heat exchangers involve the use of plate fins which have a thickness normally in the range of 0.25 millimeters or greater. With the increased costs involved in materials of constructions for heat exchangers, there is a need to reduce the amount of materials in the heat exchanger yet maintain or improve its operating characteristics.

SUMMARY OF THE INVENTION

According to an aspect of the invention, the heat exchanger for exchanging heat between a first medium carried in a tube bundle of parallel extending, spaced-apart tubes and a second medium flowing over said tube bundles has superior heat transfer characteristics and reduced material and labour costs. The heat exchanger comprises a plurality of essentially parallel spaced-apart fins extending perpendicularly to the tubes and through which the tubes extend. Each of the tubes has a wall of lightweight metal in contact with the plurality of fins to provide for heat conduction between the tubes and the fins.

The fins are ultra-thin of a thickness less than 0.20 millimeters formed of a lightweight metal, chemically and thermally compatible with the lightweight metal of the tube walls. Each of the fins has a pattern of embossments extending generally in a length dimension of each fin for increasing structural rigidity of the ultra-thin fin.

Each of the fins has an aperture through which a tube of the bundle passes. At least a portion of the ultra-thin fin about the aperture is displaced to form a flange to ensure metal to metal contact between the fin and at least a portion of the corresponding tube wall. The embossment pattern reinforces the fin about the fin flange. The fin is displaced approximately its wall thickness in forming the embossment pattern to induce turbulence in the medium flowing over the plurality of fins when the heat exchanger is in use.

According to another aspect of the invention, an ultra-thin fin is provided for use in a tube bundle type heat exchanger. The fin comprises an elongate aluminum alloy sheet having top and bottom edges and opposite side edges. The fin has a thickness of less than 0.20 millimeters and comprises a plurality of apertures through which tubes of a tube bundle extend. An embossment pattern is provided in the fin and extends generally in the length dimension of each fin for increasing structural rigidity of the ultra-thin fin. The embossment pattern curves about a portion of each aperture and is displaced approximately the thickness of the fin to induce turbulence in the medium flowing over the fin when in used on a tube bundle of the exchanger.

According to another aspect of the invention, an evaporator for use in a refrigeration device is provided and comprises a serpentine tube bundle arrangement and a plurality of parallel fins through which tubes of the tube bundle extend. The serpentine tube bundle comprises a continuous tube with an inlet and an outlet for a first heat exchange medium carried in the tube. The tube has a series of aligned reverse bends to provide a plurality of parallel tubes. The parallel tubes are arranged in sets of two as determined by the respective reverse bend. Each of the fins has a length and width dimension. Two rows of a plurality of the sets of tubes extend along the length dimension of the fin. The two parallel tubes of each set are offset laterally and slope at an angle relative to the length dimension of the fin to provide two rows of tubes for each set all sloping in the same direction.

Each of the fins of the evaporator are identical in shape and comprise an elongate ultra-thin metal body portion having top and bottom edges and opposite side edges. Two rows of spaced-apart slots are provided in the fin which are sloped relative to the length dimension of the fins to be in register with and receive a respective set of tubes. Each slot has a flange at each end which is displaced from the fin material. The parallel tubes of the set are spaced apart slightly greater than the length of the slot between the flanges. Insertion of the set of tubes through the slot provides a press fit to ensure metal to metal contact between the fin flanges and at least a portion of the respective tube wall.

Each of the fins has a similar embossment pattern for reinforcing the fin about the fin flange portions contacted by the sets of tubes. The fin is displaced sufficiently in forming the embossment pattern to induce turbulence in a heat exchange medium flowing over the plurality of fins when the evaporator is in use.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
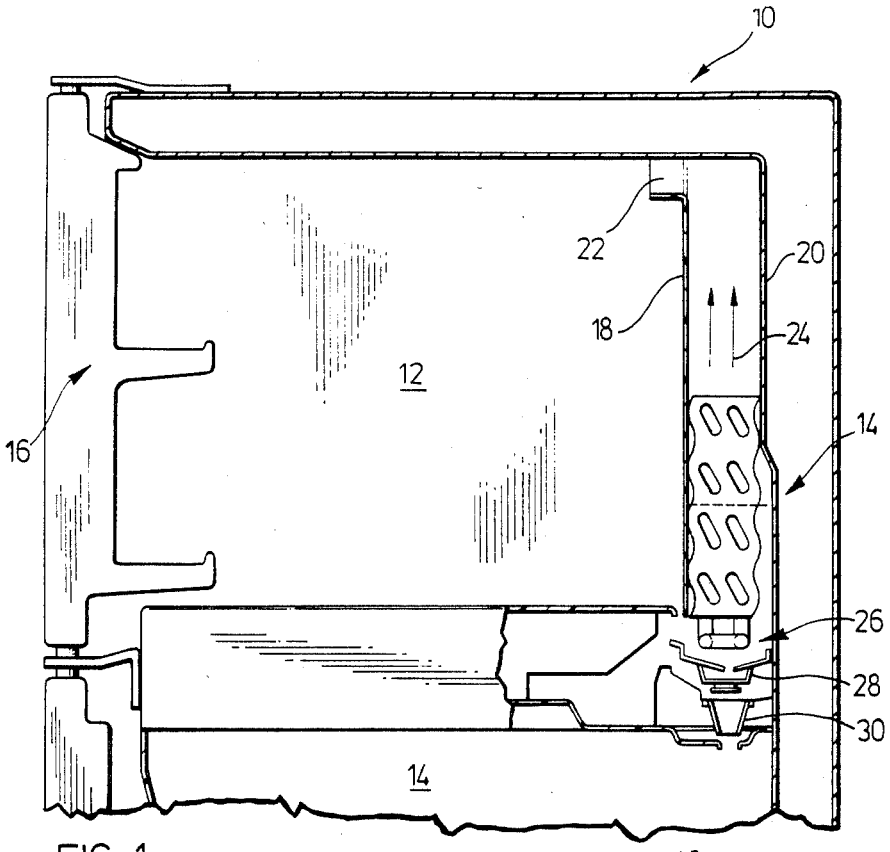
FIG. 1 is a section through a refrigerator cabinet showing disposed within the freezer compartment an evaporator according to a preferred embodiment of the invention.

Heat exchangers are used in a variety of environments to exchange heat between a first medium isolated from a second medium. For purposes of demonstrating the principles of the invention, it will be described with respect to the use of a preferred arrangement for the heat exchanger of this invention in a refrigeration device, such as the household refrigerator. Referring to FIG. 1, a refrigerator cabinet 10 has a freezer compartment 12 and refrigeration compartment 14. In accordance with standard refrigeration techniques, cold for the freezer and refrigerator compartments 12 and 14 is provided by a refrigerator evaporator 14. The freezer compartment 12 is sealed closed by door 16 having appropriate perimeter gaskets. At the rear of the compartment 12 are spaced-apart wall portions 18 and 20 with outlet 22 to the freezer compartment. Air is drawn over the evaporator 14 and directed upwardly in the direction of arrows 24 exhausted into the freezer compartment to maintain the cold therein.

Figure 2:
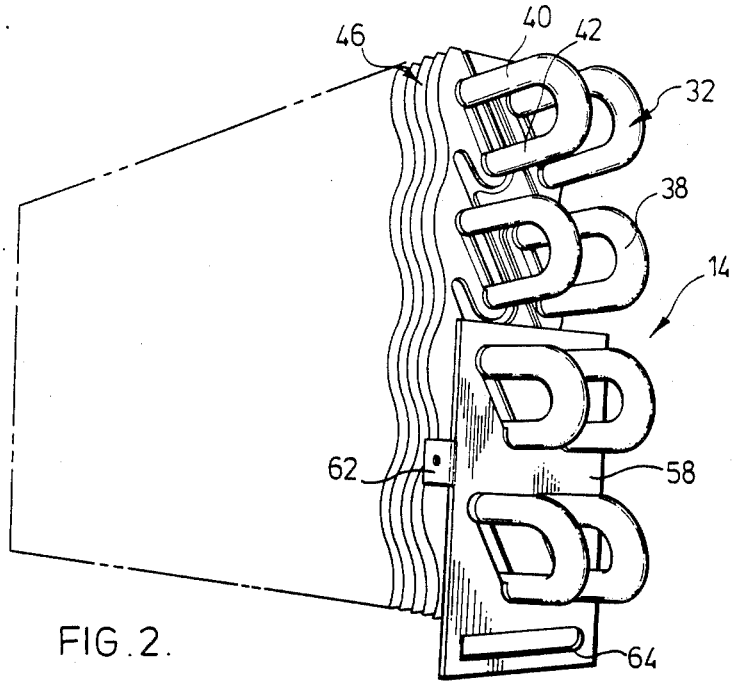
FIG. 2 is a perspective view of a portion of the evaporator shown in FIG. 1.
Figure 3:
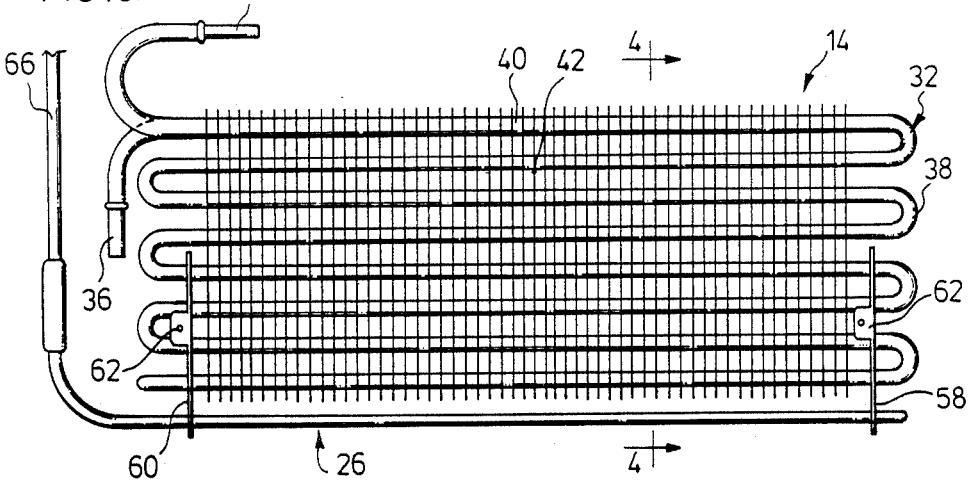
FIG. 3 is a side elevation of the evaporator of FIG. 2.

As frost and ice gather on the evaporator 14, a heater element 26 is actuated to melt ice and frost from the evaporator which is collected by pan 28 and through funnel 30 and tubing (not shown) the melted ice is removed exteriorly of the refrigerator. The evaporator 14, as shown in FIGS. 2 and 3, comprises a serpentine tube bundle 32 which is a single tube having inlet 34 and outlet 36 with a plurality of reverse bends 38 which provide several tube passes for the evaporator. The reverse bends provide sets of two tubes such as 40 and 42 which extend the length of the evaporator and are parallel and spaced apart from one another.

Figure 4:
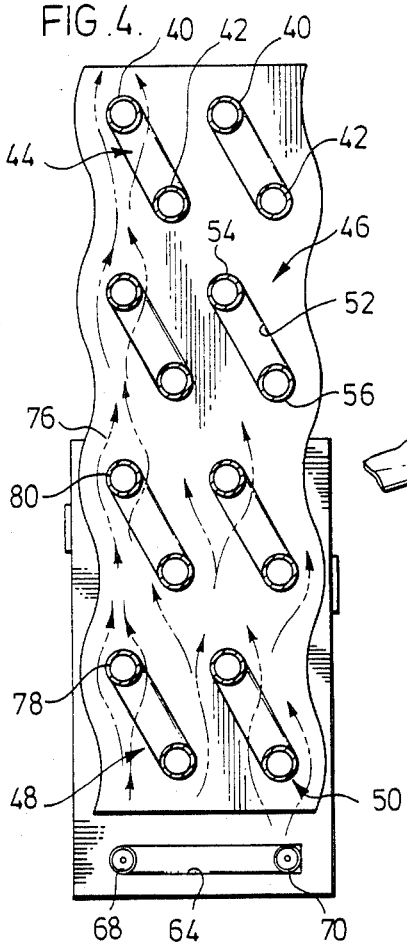
FIG. 4 is a section along the lines 4—4 of FIG. 3.

As shown more clearly in FIG. 4, tubes 40 and 42 of the tube set generally designated 44 are offset from one another and slope relative to the length of the evaporator fin 46. Each set of tubes of the serpentine tube arrangement 32 are slanted in this manner to provide two rows generally designated 48 and 50 of slanted tubes. The sets of tubes pass through apertures 52 which, according to this embodiment, are elongate slots having rounded end portions 54 and 56. The set of tubes pass through a respective slot to permit mounting of a plurality of fins 46 on the serpentine tube bundle to provide the evaporator arrangement of FIG. 3. The fins, according to this embodiment, are evenly spaced apart along the length of the serpentine tube bundle. It is appreciated, however, that a variety of spacings between the fins and number of fins per length of evaporator may be used. For example, in refrigerators of the residential type approximately seventy-five fins may be used in a tube length of 560 millimeters. In air conditioners, double the number of fins may be used in the evaporator system.

Figure 9:
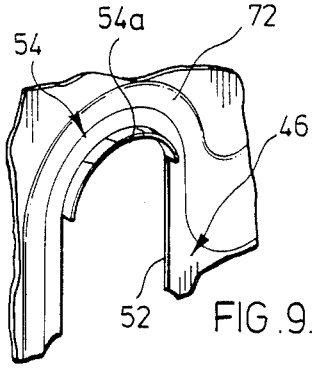
FIG. 9 shows a portion of the fin aperture prior to tube insertion.
Figure 10:
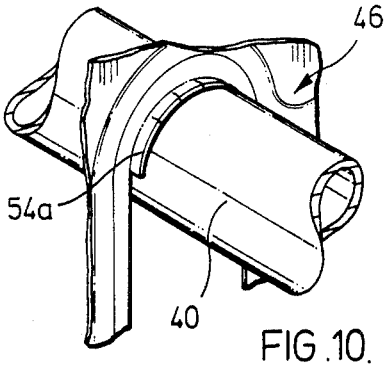
FIG. 10 shows the fin after a tube is inserted through the fin aperture illustrating the metal to metal contact.

The fins 46 have their apertures 52 sized so as to bind with the tube walls by way of a press fit in a manner to be discussed with respect to FIGS. 9 and 10, so that when all the fins are assembled on the serpentine tube bundle 32, the evaporator becomes a rigid structure. This permits the mounting of plates 58 and 60 over the reverse bend portions 38, as shown in FIGS. 2 and 3. The plates 58 are provided with lugs 62 which provide for mounting of the evaporator 14 in the refrigerator cabinet 10. In the bottom of each plate is an opening 64 through which a U-shaped heating element 26 is inserted. The U-shaped heating element 26 has two spaced-apart arms 68 and 70 as shown in FIG. 4 which abut the edges of the opening 64. The heating element has electrical leads 66 as shown in FIG. 3. The leads are connected to a power controller which, in accordance with the program of the refrigerator, is actuated from time to time to melt frost and ice which has collected on the evaporator fins 46. As a result, due to the rigid structure formed by the fins receiving the tubes, a simple mounting means for the evaporator within the refrigerator cabinet is achieved in the form of plates 58 and 60.

Figure 7:
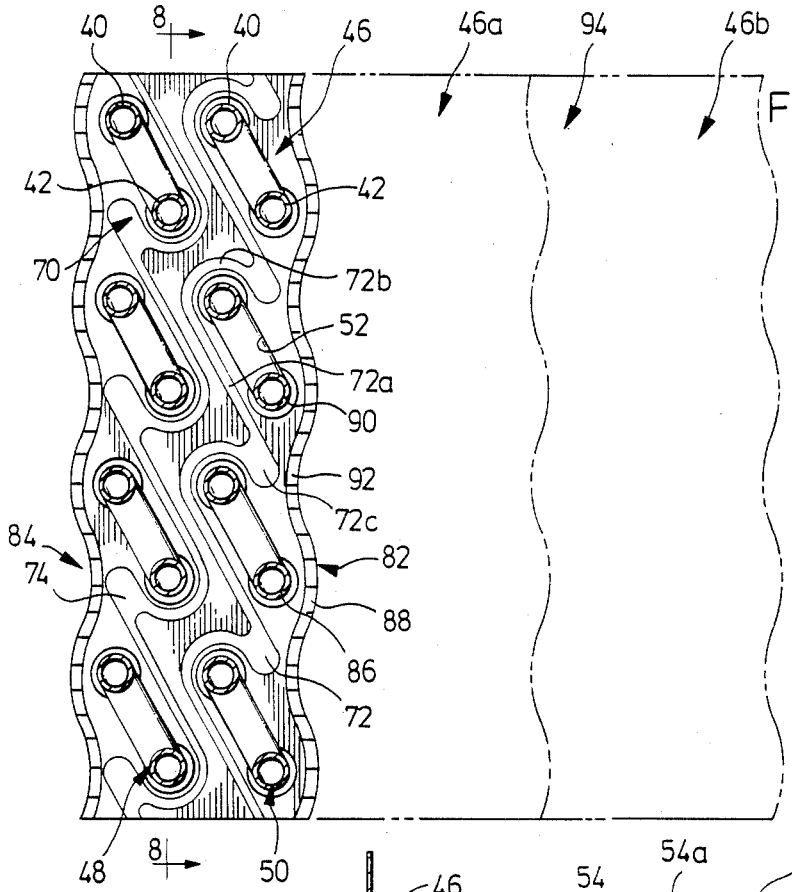
FIG. 7 is a side plan view of a fin having the tubes extending therethrough.

According to this invention, the fins 46 are ultra-thin compared to fins normally used in heat exchangers. The fins are of a thickness less than 0.20 millimeters and may be as thin as 0.10 millimeters. Referring to FIG. 7, the individual fins 46 have an embossment pattern generally indicated at 70 for structurally reinforcing the fins for handling purposes and reinforcing in the vicinity of the openings 52 through which the tubes extend. With two rows of tubes 48 and 50 and corresponding rows of apertures 52, the embossment pattern 70 consists of two ridges 72 and 74 which extend the length of the fin 46. Each ridge, for example 72, extends parallel to the aperture 52 as designated by ridge portion 72*a*. At the upper portion of the aperture 52, the ridge curves around the aperture as designated by portion 72*b* and widens into an enlarged ridge portion at 72*c* before continuing upwardly parallel to the next aperture 52 in the respective row of apertures. Similarly, ridge 74 extends the length of the fin about the apertures. In each instance, ridges 72 and 74 encircle portions of the apertures which are innermost relative to the fin width.

Figure 8:
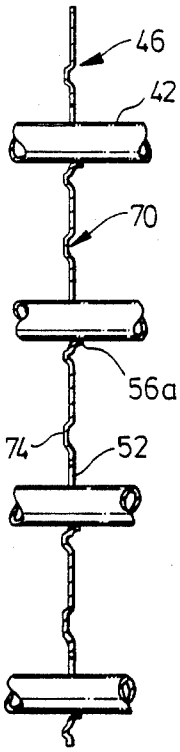
FIG. 8 is a section along the lines 8—8 of FIG. 7.

This embossment pattern in the fin considerably increases its structural rigidity, particularly through the central portion of the fin to maintain its planar characteristic when the tubes are inserted through the apertures and when so assembled on the tubes of the tube bundle, to provide a rigid evaporator structure. The embossment pattern 70, as shown in FIG. 8, has the ridge such as 74 which are displaced approximately the wall thickness of the fin 46. This displacement for the ridges is sufficient to provide the necessary structural rigidity in the fins.

Each slot 52 is such that for each set of tubes, such as 40 and 42, the portion of the fin about each end 54 and 56 of the aperture is displaced to provide a flange at each end. This displacement of the fin portion is readily accomplished due to the ultra-thin shape of the fin. As shown in FIG. 9, end portion 54 of the aperture 52 is displaced to form flange 54*a*. Similarly, the bottom portion of the slot is displaced to form flange 56*a*. Preferably, the flanges 54*a* and 56*a* are formed before the fins are assembled on the tube bundle 32; however, it is understood that the flanges may be formed during insertion of the tube sets through aligned apertures of the stack of spaced-apart fins. The formed flanges may crack slightly due to the displacement of the metal. The spacing between tubes 40 and 42 is slightly greater than the spacing between the flanges 54*a* and 56*a*. Thus the tube sets are press fitted into the aligned slots of the stack of fins to ensure metal to metal contact between the fin flanges and the tube wall to enhance heat conduction from the tube walls to the fins in exchanging heat with the refrigeration medium as it flows over the fins. Preferably a nominal oversizing of the tube spacing of approximately 0.125 mm provides an adequate press fit of the tube bundle in the stack of fins.

The embossment pattern 70, as it encircles the innermost portions of the apertures, provides reinforcing about the fin flanges to prevent the cracks in the flange from travelling further in the fin to maintain the structural integrity of the assembled unit. This pushing of the tubes through the undersized apertures and thereby press fitting against the ultra-thin metal, binds the fins to the tubes to give the necessary rigidity and at the same time, an effective efficient heat transfer between the tubes and fins.

According to the arrangement provided in FIG. 1, the refrigeration air travels upwardly over the evaporator 14 and is exhausted through port 22. By slanting the sets of tubes for the evaporator serpentine tube arrangement, more passes of tubes may be provided per predetermined height of the evaporator. Furthermore in slating the two sets of tubes as shown in FIG. 4, the upwardly travelling air in the direction of arrows 76 passes over in essence four aligned rows of tubes. Corresponding tubes of adjacent sets, such as at 78 and 80, are spaced apart twice the distance of a normal evaporator configuration where the sets of tubes are all vertically aligned. This allows the air currents 76 to divide over the first tube 78 and rejoin before being broken up again in travelling over tube 80. Thus tube 80 does not lie in the downward eddy currents of tube 78, so that a more effective heat transfer is realized. To further improve upon the transfer of heat to the air current 76, it has been found that the reinforcing embossment pattern in the fins provides ridges of sufficient height which induces turbulence in the air currents as they travel upwardly along the fins. This avoids boundary layers being formed along the fins so that there is an increased rate of heat transfer from the fins to the moving air.

The opposite side edges generally designated 82 and 84 of the fins, as shown in FIG. 7, have an undulating pattern. According to the preferred embodiment of this invention, the undulating pattern is in the form of a wave which may be sinusoidal in shape. In the vicinity of a tube 86, which is adjacent the side edge 82, the fin has an outwardly extending portion 88 which curves around the tube 86. Between tubes 86 and 90 where there is no tube adjacent the side edge 82, the fin has an inwardly extending portion 92. This resultant undulating pattern improves on the efficiencies of heat transfer from the fins to the refrigerant air. This is due to the heat being conducted away from each tube in a radial pattern. In the space between tubes 86 and 90, for example, there is no tube immediately adjacent the side edge so that that portion of the metal does not effectively transfer heat to the refrigerating air. Thus, this portion of the metal may be removed from the fin thereby saving on the amount of metal which goes into the fin. The undulating pattern may be symmetrical, so that when the fins are stamped from a sheet of metal 94, each fin may have the same shape in the form of additional fins 46*a* and 46*b*.

Figure 6:
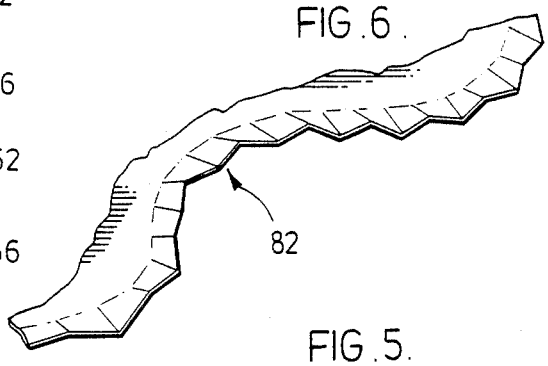
FIG. 6 is a section of the edge of a fin of FIG. 5.
Figure 5:
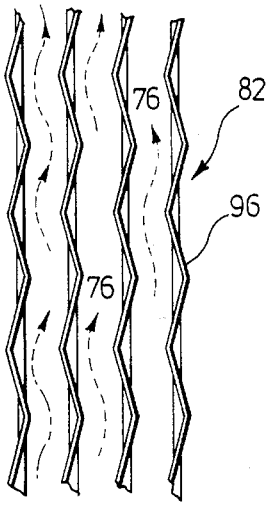
FIG. 5 is an edge view of a portion of the evaporator of FIG. 3 showing the edge fin configuration.

To further improve the heat transfer efficiencies, the opposite side edges 82 and 84 of each fin are crimped as shown in FIGS. 5 and 6. The crimping may be in the form of a triangular pattern 96 which induces additional turbulence in the air currents 76 as the air travels over the fin edges.

The tubing and the fins may be made from various commercial grades of aluminum alloy, such as that commonly used in the making of evaporators for refrigerators. It is appreciated, however, that any other form of suitable metal having appropriate heat conductivities may be used which can be formed into the serpentine tubing and also the ultra-thin fins. By way of the embossment pattern enabling the use of considerably thinner fins, an appreciable reduction in weight of the system may be achieved. A further reduction in weight is also realized by the undulating pattern for the fin edges. Alternatively, because of reduction in weight more fins may be used per evaporator unit to increase the efficiencies of the arrangement. By providing the embossment pattern in the fins, the resultant increase in turbulence over the fin surface greatly improves the heat transfer efficiencies. Comparing the existing evaporator to the normal form of evaporator in a refrigerator, it has been found that per fin there is approximately a 50% reduction in material, resulting in approximately 22% improvement in overall costs of the material for the assembled evaporator.

EXAMPLE 1

Calorimeter tests were conducted to establish the percent improvement in heat transfer in comparing an existing evaporator design for a refrigerator to that shown in FIG. 1. The following results were obtained as itemized in Table I.

TABLE I

| Air Flow | Heat transfer (B.T.U./Hr. Deg. F) | | |
|---|---|---|---|
| CFM (Cu. Ft/Min) | Current Design | Design of FIG. 2 | Percent Increase |
| 20 | 24.8 | 28.0 | 12.9 |
| 30 | 30.5 | 33.1 | 8.5 |
| 40 | 36.2 | 41.2 | 13.8 |
| 50 | 42.3 | 49.6 | 17.3 |
| 60 | 43.4 | 53.3 | 22.8 |
| 70 | 54.2 | 62.0 | 24.4 |
| 80 | 60.0 | 75.6 | 26.0 |

For the increased flows of refrigerant air, increased efficiencies in the range of 25% are obtained with this system. This in combination with the reduced material costs provide an evaporator significantly superior to existing designs.

Although preferred embodiments of the invention have been described herein in detail, it will be understood by those skilled in the art that variations may be made thereto without departing from the spirit of the invention or the scope of the appended claims.

The embodiments of the invention in which an exclusive property or privilege is claimed are defined as follows:

1. A heat exchanger for exchanging heat between a first medium carried in a tube bundle of parallel extending spaced-apart tubes and a second medium flowing over said tube bundle, said heat exchanger comprising a plurality of essentially parallel spaced-apart fins extending perpendicularly to said tubes and through which said tubes extend, each of said tubes having a wall of lightweight metal in contact with said plurality of fins to provide for heat conduction between said tubes and said fins, said fins being ultra-thin of a thickness less than 0.20 mm formed of a lightweight metal chemically and thermally compatible with said lightweight metal of the tube walls, each of said fins having a pattern of embossments extending generally in a length dimension of each fin for increasing structural rigidity of said ultra-thin fin, each of said fins having plural aperatures through which tubes of said bundle pass, at least a portion of said ultra-thin fin about each said aperture is displaced to provide a flange which contacts at least a portion of corresponding tube wall, said embossment pattern reinforcing said fin about said fin flange by providing a continuous ridge having a curved ridge portion adjacent to and encircling a portion of each said flange disposed centrally of said fin and extending substantially the length of said fin, said fin being displaced approximately its wall thickness in forming said embossment pattern to induce turbulence in the medium flowing over said plurality of fins when said heat exchanger is in use.

2. A heat exchanger of claim 1 wherein each of said fins is generally elongate in outline having two opposite shorter edges and two opposite longer edges, each of said longer edges having an undulated pattern along its length, said fin having an outwardly extending portion of said undulated fin pattern in the area adjacent said tubes of said bundle and an inwardly extending portion of said undulated fin pattern in the area between adjacent tubes of said bundle which are proximate said longer edge.

3. A heat exchanger of claim 2, wherein said undulating fin edges are crimped to induce further turbulence in the medium flowing over said plurality of fins when said heat exchanger is in use.

4. A heat exchanger of claim 2, wherein said undulating pattern for each said opposite longer fin edge is defined by a sinusoidal wave, the wave pattern of each fin longer edge is symmetrical with the other opposite fin edge.

5. A heat exchanger of claim 1, wherein said parallel extending spaced-apart tubes are arranged in sets of two, each of said fins having a length and a width dimension, two rows of a plurality of said sets of tubes extending along said length dimension of said fin, said two parallel tubes of each set being offset laterally and sloping at an angle relative to said length dimension of said fin to provide two rows of sets of tubes all sloping in the same direction.

6. A heat exchanger of claim 5, wherein said embossment pattern consists of a ridge extending along each row of said sets of tubes, said ridge being adjacent and extending parallel with each set of tubes, encircling said fin flange portion of the innermost tube of said set and continuing parallel with the next set.

7. A heat exchanger of claim 5, wherein said bundle of tubes is a continuous serpentine-like tube with an inlet and outlet for a first medium carried in said tube bundle, said parallel tubes of each said set being formed by a reverse bend in said tube to provide laterally offset parallel tubes.

8. A heat exchanger of claim 7, wherein said aperture is an elongate slot of a length slightly less than the outside dimensional spacing of said parallel tubes of a set, each end of said slot being provided with said flange portion, said reverse bend in said tube passing through said slot and thereby press fitted against each slot end.

9. A heat exchanger of claim 1, 2 or 5, wherein said plurality of fins and said tube bundle are made from aluminum alloys.

10. An evaporator for use in a refrigeration device, said evaporator comprising a serpentine tube bundle arrangement and a plurality of parallel fins through which tubes of said tube bundle extend, said serpentine tube bundle comprising a continuous tube with an inlet and an outlet for a first heat exchange medium carried in said tube, said tube having a series of aligned reverse bends to provide a plurality of parallel tubes, said parallel tubes being arranged in sets of two as determined by the respective reverse bend, each of said fins having a length and width dimension, two rows of a plurality of said sets of tubes extending along said length dimension of said fin, said two parallel tubes of each set being offset laterally and sloping at an angle relative to said length dimension of said fin to provide two rows of sets of tubes all sloping in the same direction, each of said fins being identical in shape and comprising an elongate ultra-thin metal body portion having top and bottom edges and opposite side edges, two rows of spaced-apart slots being provided in said fin which are sloped relative to the length dimension of the fin to be in register with and receive a respective set of tubes, said parallel tubes of said set being spaced apart slightly greater than the length of said slot, opposite portions of said ultra-thin fin about said slot having flanges against which said set of tubes are press fitted to ensure metal to metal contact between said fin and at least a portion of the respective tube wall, each of said fins having similar embossment pattern for reinforcing said fin about said fin flanges, said embossment pattern comprising two continuous ridges extending the length of said fin, each ridge being associated with each row of slots, said ridge extending parallel with each slot, curving around the innermost portion of each slot relative to the fin width to reinforce said fin flange and continuing parallel to the next slot of the row, said two continuous ridges as they traverse portions of said fin diagonally thereby reinforce the central region of each fin along its length, said fin being displaced sufficiently in forming said embossment pattern to induce turbulence in a second heat exchange medium flowing over said plurality of fins when said evaporator is in use.

11. An evaporator of claim 10, wherein said tube bundle is oriented in said refrigeration device in a manner that a second heat exchange medium flows over said fins in the direction of their length dimension.

12. An evaporator of claim 11, wherein said opposite side edges of each said fin have a wavy pattern in the form of a sinusoidal wave, said fin having an outwardly extending portion of said wave pattern in the area adjacent a tube of said bundle and an inwardly extending portion of said wave pattern in the area between tubes which are proximate said edge of adjacent sets of tubes.

13. An evaporator of claim 11 or 12, wherein said opposite side edges are crimped.

14. An evaporator of claim 10, wherein said press fit of said sets of tubes into said fin apertures forming a rigid assembly of said plurality of fins on said tubes, said reverse bends of said serpentine tube bundle extending beyond said fins, mounting means connected to said reverse bend portions on each side of said evaporator for mounting said evaporator in a refrigerating device.

15. An evaporator of claim 10, wherein said tube bundle and said fins are formed from aluminum alloys.

* * * * *

UNITED STATES PATENT AND TRADEMARK OFFICE

CERTIFICATE OF CORRECTION

PATENT NO. : 4,580,623

DATED : April 8, 1986

INVENTOR(S) : Cory Ter Smitte et al

It is certified that error appears in the above-identified patent and that said Letters Patent is hereby corrected as shown below:

On the title page inventor should read:

--(75) Inventors: Cory Ter Smitte, Hamilton; Rico D. Ferrelli, Thorold, both of Canada --.

Signed and Sealed this

*Eighth* Day of *July 1986*

[SEAL]

*Attest:*

DONALD J. QUIGG

*Attesting Officer*

*Commissioner of Patents and Trademarks*